US005332375A

United States Patent [19]

Kuechler

[11] Patent Number: 5,332,375

[45] Date of Patent: Jul. 26, 1994

[54] ROTARY PISTON MACHINE

[76] Inventor: Jurgen Kuechler, An den Alten Graben 9, W-3556 Weimar/Niederwalgern, Fed. Rep. of Germany

[21] Appl. No.: 67,095

[22] Filed: May 26, 1993

[30] Foreign Application Priority Data

May 26, 1992 [DE] Fed. Rep. of Germany ..... 9207087

[51] Int. Cl.[5] ..... F01C 19/00

[52] U.S. Cl. ..... 418/138; 418/235

[58] Field of Search ..... 418/235, 259, 138

[56] References Cited

U.S. PATENT DOCUMENTS

| | | | |
|---|---|---|---|
| 2,071,799 | 2/1937 | Mabille | 418/235 |
| 2,448,233 | 8/1948 | Nyborg | 418/235 |
| 3,072,068 | 1/1963 | Weiss | 418/235 |
| 3,401,872 | 9/1968 | Adsit | 418/235 |
| 3,433,605 | 3/1969 | Knorre . | |
| 3,552,895 | 5/1969 | Bayley | 418/235 |
| 3,572,985 | 3/1971 | Runge . | |
| 4,354,462 | 10/1982 | Kuechler . | |

FOREIGN PATENT DOCUMENTS 2590932 12/1985 France .

*Primary Examiner*—Louis J. Casaregola
*Assistant Examiner*—Charles G. Freay
*Attorney, Agent, or Firm*—Fred Philpitt

[57] ABSTRACT

A rotary piston machine that includes a casing with a drive shaft that connects to an annular body having arc-shaped segments having swivelling fulcrums that hold slidable vanes which define chambers of varying size within said casing together with inner and outer rings that are each integral with a vane, and movable relative to each other within a ring stack (30), the axis of the ring stack being parallel to the drive shaft axis but offset so that said vanes assume varying angular positions as they revolve.

14 Claims, 4 Drawing Sheets

ROTARY PISTON MACHINE

FIELD OF THE INVENTION

Figure 2:
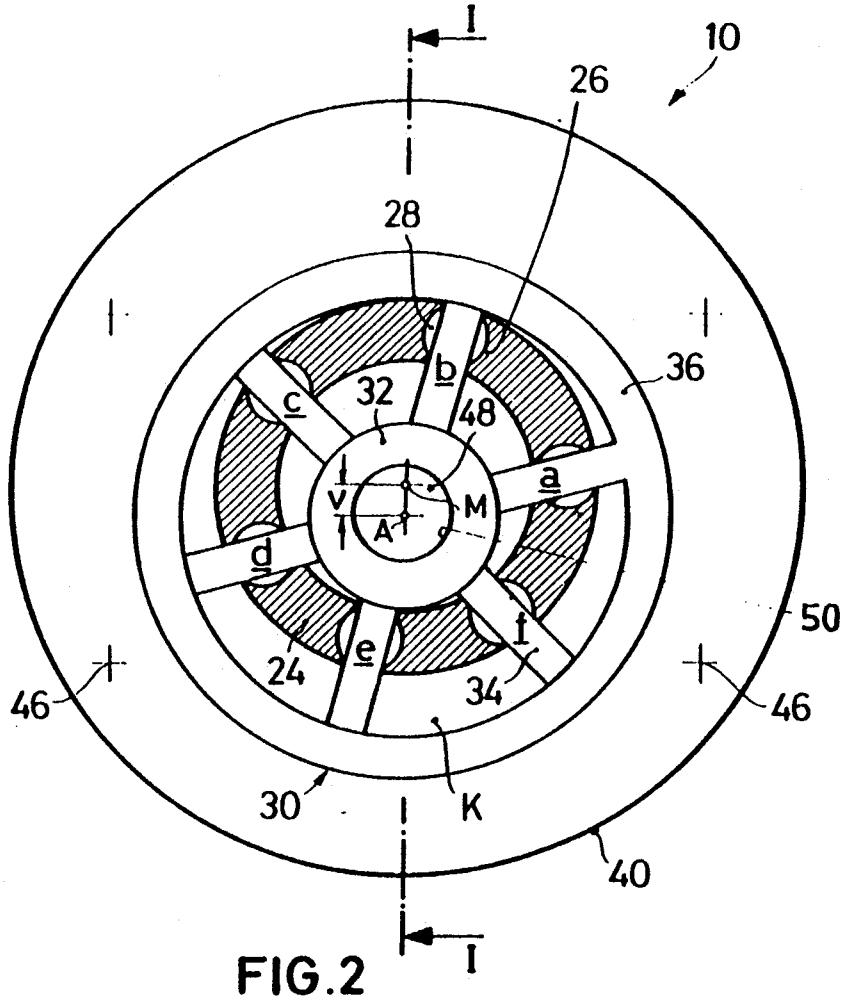

The invention relates to a rotary piston machine.

Machines of this type may be pumps or compressors; they may be designed as engines, e.g. as internal combustion chamber turbines.

PRIOR ART

Such conventional machines include in a casing an annular body which is eccentrically arranged relative to a main shaft. For pumps and compressors, all of a chamber system wherein vanes define variable chamber volumes is rotatably driven.

For example, a machine disclosed in CH 445 947 C1 comprises vanes that extend radially and slidably through an annular body, their ends brushing along an inner casing wall as well as an inner sleeve in a fashion similar to US 3 572 985 A1. Drawbacks consist in rather cumbersome mounting and in less favorable support and lubrication conditions; also, several peripheral positions require that the annular body be specially designed to include recesses and projections. Various conventional designs include vane guides such as fulcrum slides or pronged joints held between segments of the annular body, permitting tilting motions of the vanes so that they assume different angular positions during each revolution. Serious practical problems arise from the vane ends sliding along the inner casing wall so that as a trailing vane tilts over into an advancing position, excessive edge pressure may cause deterioration and most undesirable deformation of the confining wall. Such disadvantages are avoided by a system according to US 4 354 462 which, however, requires a non-cylindrical casing with the consequence of considerable manufacturing difficulties.

OBJECTS OF THE INVENTION

It is an important object of the invention to improve, in an economical manner, a rotary piston machine of the type mentioned above so as to provide a sturdy design that can be easily manufactured and quickly assembled and will have a long service life.

Another object is the development of a rotary piston machine providing both smooth and economical running over a wide range of speeds and torques.

A further object of the invention consists in providing a rotary piston machine of high power-weight ratio that is suitable for various fields of application.

Yet another object of the invention is to create a rotary piston machine structure suited for particular ease of maintenance.

SUMMARY OF THE INVENTION

In a rotary piston machine of the type dealt having a casing for support of a drive shaft that entrains an annular body for rotation around an axis offset relative to the drive shaft axis, the annular body being guided between adjacent end faces at either side and including arc-shaped segments as well as swivelling fulcrum slides which are parallel to said axis and in which vanes are slidable that define a plurality of chambers of varying size within and/or outside the annular body, the present invention provides that the vanes each comprise a ring component and, that these ring-and-vane components are peripherally offset and movable relative to each other within a ring stack and that the drive shaft including the annular body attached thereto or integral therewith is centrally supported in the casing.

Thus during every revolution each ring-and-vane component will continuously vary its angular position to the neighboring ring components without any mutual influences in the ring stack. At any moment, the actual vane positions define inner and/or outer chambers which change their sizes as they revolve since the axes of the driving annular body and of the driven ring stack are offset. Both in a compressor and in a pump, a—possibly compressible—fluid obtained from an intake will be delivered under higher pressure and will then be exhausted.

Each ring-and-vane component may comprise a concentric pair of an inner and an outer ring, both being rigidly attached to or integral with one vane; the ring-and-vane components are preferably stacked by steps of at least one ring width each. This clear-cut design provides a most simple and reliable solution to sealing problems.

Advantageously, a cover plate fixed to the casing supports an eccentric ring for sliding engagement of a facing ring-and-vane component of the annular body, which contributes to both very little friction and smooth running. The ring stack is quite compact and is easily supported, in particular if inner rings are rotatably borne by an eccentric trunnion either rigidly attached to or integral with a cover plate. However, all the ring-and-vane components are centered relative to the trunnion whereby quiet operation is further enhanced.

As the annular body is rigidly attached to or integral with a plane driving disk which in turn is connected to the drive shaft, excellent sealing as well as low friction is ensured since only plane revolving parts slide along each other.

In another rotary piston machine of the same basic structure the invention provides an annular body having a cylinder that is coaxial to the drive shaft and is guided in a closing plate eccentrically arranged relative to the axis of a central ring stack, the vanes being peripherally offset and associated to a ring component each of the stack within which the individual ring-and-vane components are movable relative to each other. It will be noted that compared to the above-described type of machine, the rotational axes are exchanged between the annular body and the ring stack. As the basic design is the same, there will again be no mutual influencing of the ring-and-vane components as they move relative to each other during their con, non revolving motion. The annular body separates the inner and outer chambers; at the same time, it provides solid bearing and excellent sealing.

In this type of machine, too, each ring-and-vane component includes a concentric pair of an inner and an outer ring rigidly attached to or integral with one vane each, stacking being provided by steps of at least one ring width each. The design ensures high stability and quiet running. The drive shaft is, in particular, solid with the annular body, and the closing plate is similarly solid with a central trunnion bearing the rotatable ring stack which may be encompassed by or supported within a jacket. This will further contribute to achieve smoothness of running.

A front face of the casing may be sealingly and slidably engaged by the annular body and/or by a plane driving disk so that full support at the face ends is combined with minimum friction as only plane parts slide along each other. In like manner, a cover plate fixed to the casing may include an end face for sliding engagement of a facing ring component of the ring stack so as to provide both stable support and little friction. An additional contribution to sealing is attained if an inner ring of that ring-and-vane component which is directly adjacent to a plane driving disk supports and tightly engages a slide disk. For the same purpose, a bearing for the drive shaft may be covered by an outer disk seated in the casing.

Further features, particulars and advantages of the invention will become apparent from the following elucidation of preferred embodiments shown.

IN THE ANNEXED DRAWINGS

Figure 1:
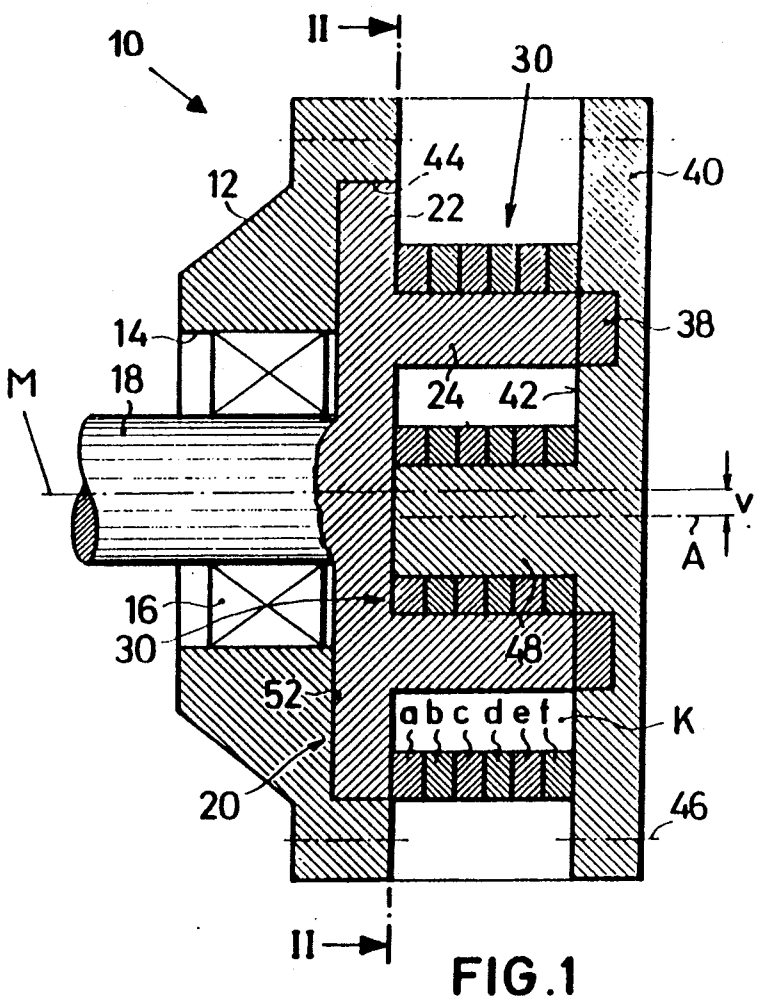
Figure 5:
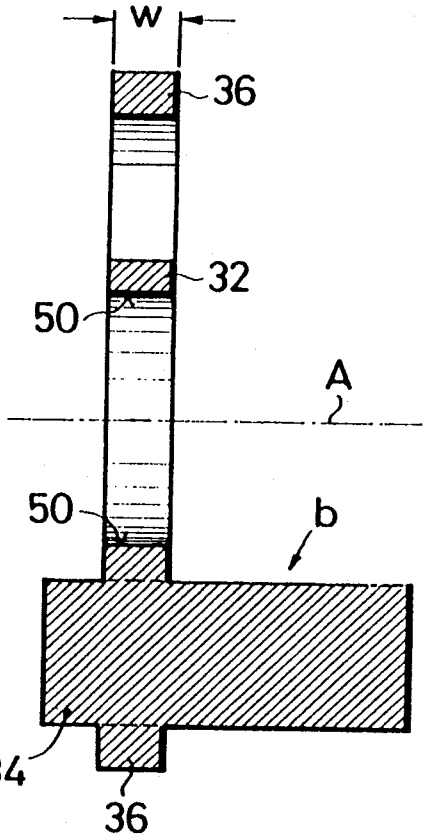
Figure 4:
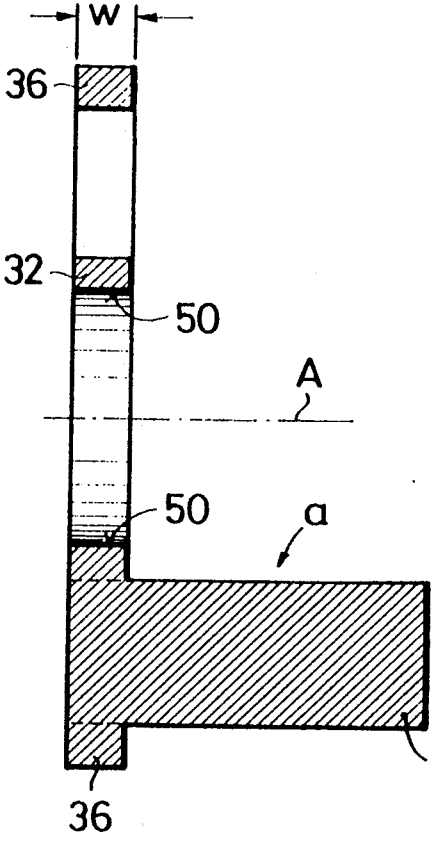
Figure 3:
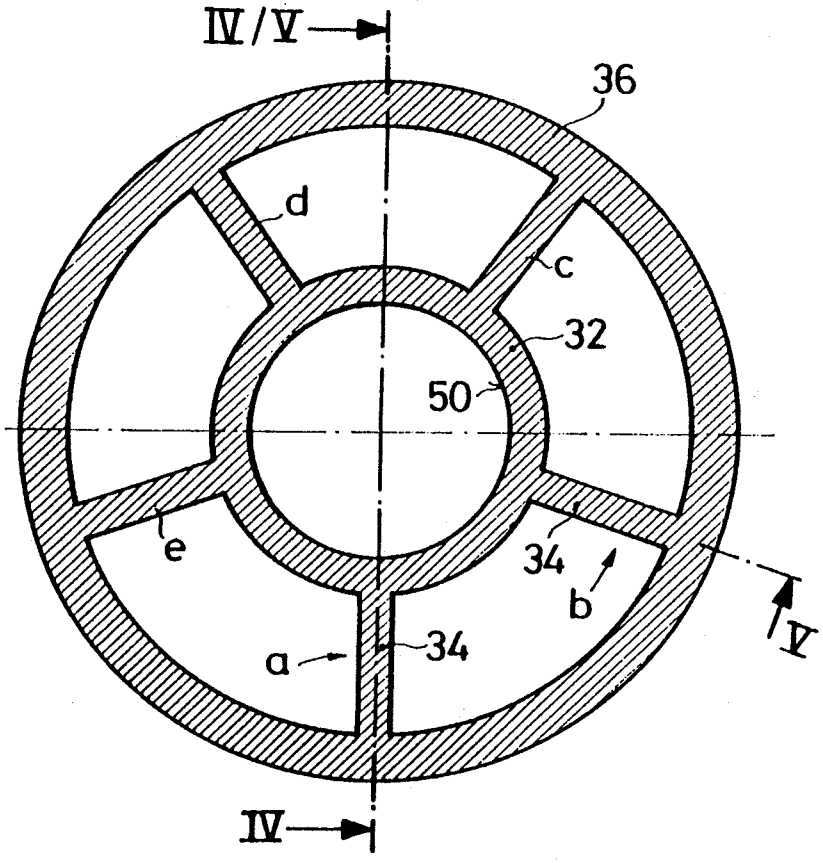
Figure 6:
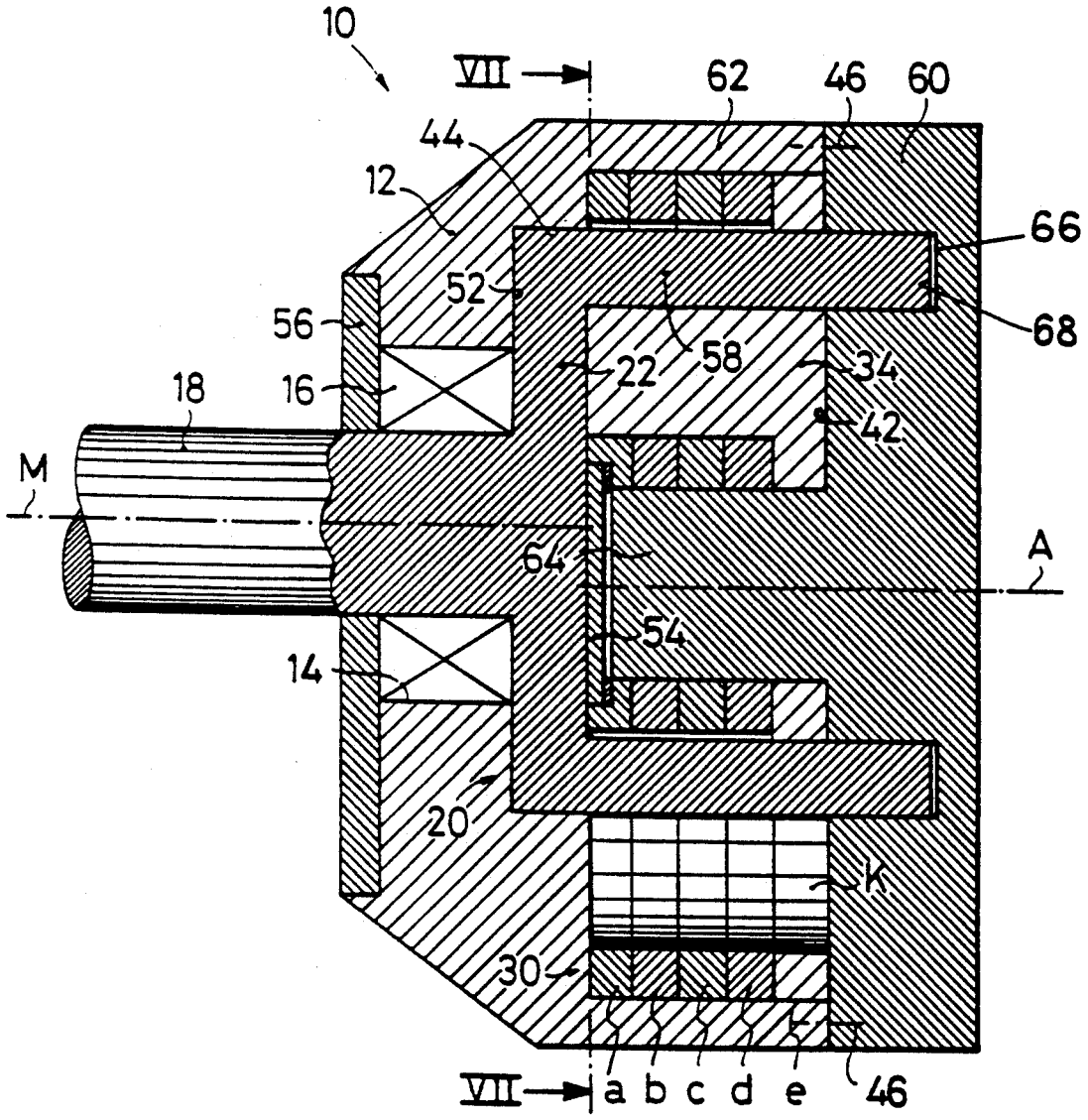
Figure 7:
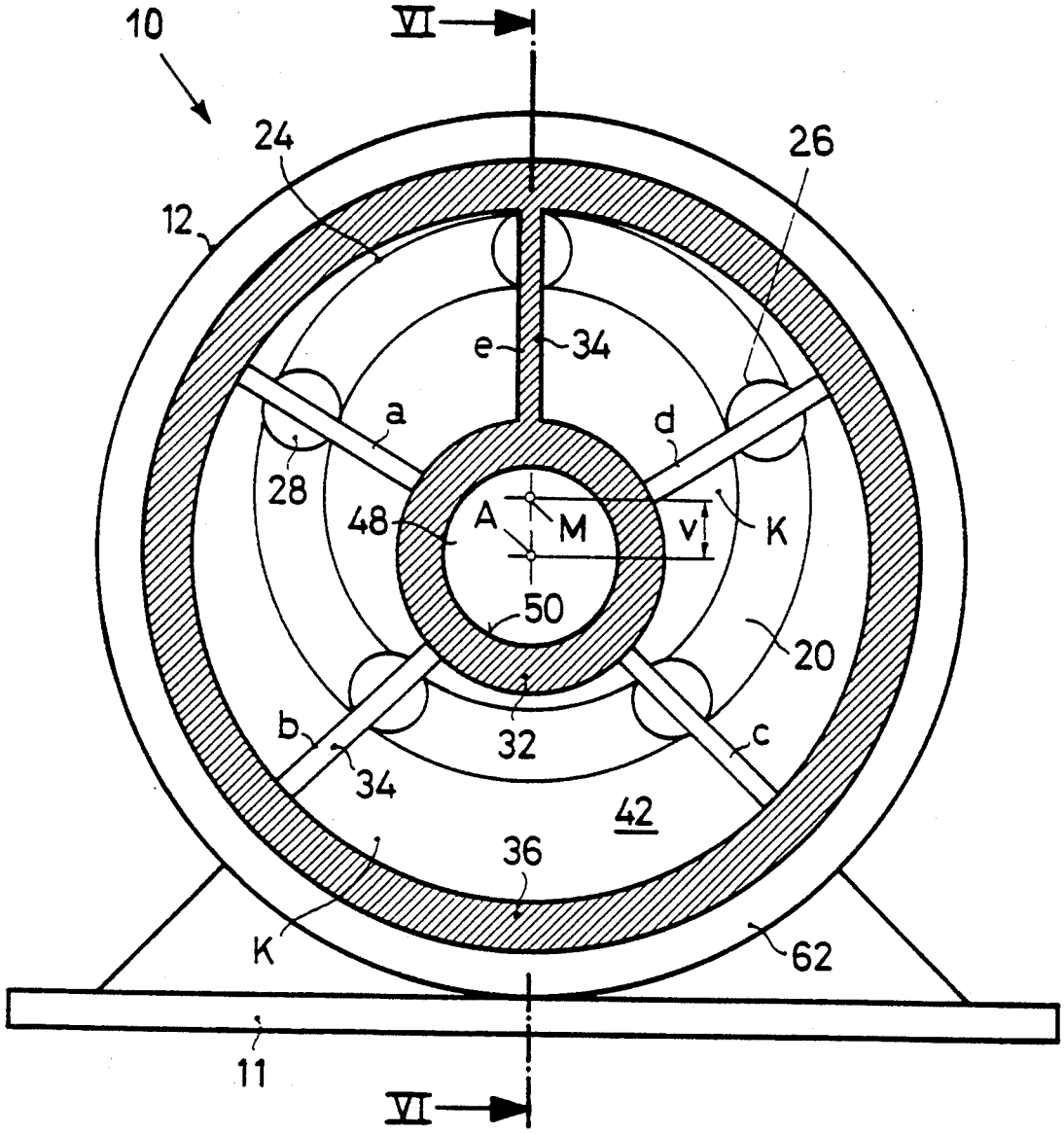

FIG. 1 is an axial sectional view along line I—I in FIG. 2 of a rotary piston machine, FIG. 2 is a cross sectional view along line II—II in FIG. 1, FIG. 3 is a cross sectional view of a ring-and-vane component, FIG. 4 is a sectional view along line IV—IV in FIG. 3, FIG. 5 is a sectional view along line V—V in FIG. 3, FIG. 6 is an axial sectional view along line VI—VI in FIG. 7 of another rotary piston machine, and FIG. 7 is a cross sectional view taken along line VII—VII in FIG. 6.

DESCRIPTION

A machine of the type shown in FIGS. 1 and 2 is generally designated by 10 and includes a casing 12 having a bore 14 which receives a bearing 16 for a drive shaft 18. The latter is rigidly attached to or integral with an annular body 20 consisting of a plate or plane driving disk 22 and of arc-shaped segments 24 which hold fulcrum slides 28 between recesses 26 (FIG. 2).

In these fulcrum slides 28, vanes 34 are slidable each of which is integral with a ring pair made up of an inner ring 32 and an outer ring 36 (FIGS. 2 and 3). The individual ring-and-vane components of such a ring stack 30 (FIG. 1) comprise angularly offset vanes 34 that define chambers K seen in FIG. 2 where the arrangement includes six ring-and-vane components a, b, c, d, e, f. By contrast, FIG. 3 shows a design featuring five ring-and-vane components a, b, c, d, e of which the components a, b are seen in the sectional views of FIGS. 4 and 5, respectively. It will be noted that the ring-and-vane components, i.e. the rigid units of an inner ring 32 with a vane 34 and an outer ring 36, are stacked by steps of at least one ring width w each; for example, in a further view (not shown) ring-and-vane component c would have the inner and outer rings 32, 36 one step farther to the right along vane 34 as compared to FIG. 5.

The inner rings 32 have an inner annular surface 50 bearing on an eccentric trunnion 48 that is rigidly attached to or integral with a cover plate 40 (FIG. 1). The axis A of trunnion 48 is spaced from the parallel axis M of the driving shaft 18 by an offset Z whereby the ring stack 30 will eccentrically revolve around the central annular body 20 whose inner/lower ends slide along an eccentric ring 38 that is lodged in the cover plate 40 and flush therewith. A recess 44 in casing 12 serves to radially confine the driving disk 22 that is slideable along a plane front face 52. Casing 12 is peripherally attached to cover plate by bolt fixings 46, possibly with intermediate distance pieces (not shown) that encompass the ring stack 30 jacketwise.

The embodiment described is a rotary pump for two pumping circulations, outer chambers K receiving the fluid to be pumped via an intake (not shown). For clarity's sake, a passage is not shown, either, through which the pumped fluid is introduced into the inner chambers which may deliver about two thirds of the volume passed by the outer chambers. The pump may be also designed for separate circulations with separate intakes and exhausts in each circuit.

In operation, drive shaft 18 will under power from a motor (not shown) entrain the ring stack 30 via the annular body 20 so that the vanes 34 assume varying angular positions to each other, resulting in variable chamber volumes. The relative motion of the vanes 34 is possible owing to the fact that they are slidably held in the fulcrum slides 28. Since all the ring-and-vane components revolve as a stack 30 with the same number of revolutions per unit of time, but under continuous phase shifting, deviations due to tolerances are principally irrelevant and harmless for the overall system. Furthermore, as merely small intermovements occur between the ring-and-vane components a to e or a to f, respectively, little energy is lost through friction. If need be, sealing elements (not shown) may be provided along the outer edges of vanes 34 in order to still improve the sealing the ring stack 30.

The pumping system is easily lubricated, viz. via the eccentric trunnion 48 for the inner rings 32 and—e.g. via the annular body 20—for the outer rings 36. Radial forces will be completely received by recess 44 of casing 12 and, if provided, by jacket portions. The machine is largely insensitive to ambient influences, operates with extremely little noise and is designed for ease of maintenance.

As a compressor system, the same basic structure can be used if there are additional passages ( not shown ) in the cover plate 40 for transition of compressed air from the outer chambers K into the inner set of chambers. It is possible to provide intermediate cooling for the first compressing stage. The compressed air will be exhausted via an outlet (not shown) in the stationary casing 12.

FIGS. 6 and 7 show another type of rotary piston machine where a driving shaft 18 as well as a driving disk 22 and a cylinder 58, which is preferably integral therewith, are eccentrically seated in casing 12 whose bore 14 includes a bearing 16 topped by an outer disk 56. Casing 12 comprises a peripheral jacket 62 attached to a closing plate 60 by bolt fixings 46. Closing plate 60 is preferably integral with a central trunnion 64 bearing the inner rings 32 of ring stack 30 which in the example shown comprises five ring-and-vane components a, b, c, d, e. Inner ring 32 of component a may include a slide disk 54 engaging the inner end face of annular body 20 as well as the end face of central trunnion 64 with little friction but good sealing. The lower/inner end of cylinder 58 is slidably received by an annular groove 66.

Again, there is an offset Z between the axes A and M of the two systems 20 and 30, respectively, which rotate with an identical number of revolutions per unit of time. Consequently, the five ring-and-vane components a, b, c, d, e of ring stack 30 move under angular phase shifting of the vanes 34 relative to each other and to the annular body 20 whereby the volumes of chambers K vary continuously and the desired compression is attained. Outer and inner circuits may be separate or may be arranged in series to achieve a two-stage circulation.

The invention is not restricted to the particular embodiments described. However, it will be evident that preferred rotary piston machine types include a casing 12 with a bearing 16 for a drive shaft 18 that entrains an annular body 20 having arc-shaped segments 24 guided between end faces 42, 52 and having swivelling fulcrum slides 28. These hold slidable vanes 34 which define chambers K of varying size within and/or outside the annular body 20. Ring-and-vane components (a to e; a to f) include an inner ring 32 as well as an outer ring 36 and a vane 34 each; they are stacked by steps of at least one ring width w and are movable relative to each other within a ring stack 30 borne on a trunnion 48; 64 of a cover plate 40 or of a closing plate 60, respectively. The axis A of the ring stack 30 is parallel to the drive shaft axis M but spaced thereform by an offset v so that the vanes 34 assume varying angular positions as they revolve. Drive shaft 18 and annular body 20 may be arranged concentrically (FIGS. 1 and 2) or eccentrically (FIGS. 6 and 7) in the casing 12 so that, conversely, ring stack 30 will slide eccentrically along cover plate 40 or concentrically along closing plate 60, respectively.

While preferred embodiments have been illustrated and explained hereinabove, it should be understood that numerous variations and modifications will be apparent to one skilled in the art without departing from the principles of the invention which, therefore, is not to be construed as being limited to the specific forms described.

I claim:

1. A rotary piston machine (1) comprising in combination (a) a casing (12, 40, 60), (b) a central annular body (20) mounted for rotation within said casing (12, 40, 60) said central annular body (20) comprising a cylindrical array of arc-shaped elements (24), (c) a drive shaft (18) supported by said casing (12, 40, 60) and coaxially joined to said central annular body (20) so as to rotate said central annular body (20) about a first axis (M), (d) swiveling fulcrum slides (28) located in said arc-shaped elements (24), which slides are parallel to said first axis (M), (e) a plurality of ring and vane members (a-f) mounted in a stack (30) in said casing (12, 40, 60) for rotation around a second axis (A) that is offset from said first axis (M), said ring and vane members:

(i) each comprising a pair of concentric rings including an inner ring (32) and an outer ring (36), (ii) each comprising a vane (34) that extends between and is integral with both the inner ring (32) and the outer ring (36) of each ring pair, each vane (34) being slidable within one of said swiveling fulcrum slides (28) so as to thereby define a plurality of separate and spaced apart chambers (k) within said casing (12, 40, 60), (iii) being peripherally offset and movable relative to each other within said ring stack (30), (iv) being stacked by intervals of at least one ring width (w) each.

2. A rotary piston machine according to claim 1 wherein a cover plate (40) is bolted to said casing (12) and supports an eccentric ring (38) for sliding engagement with a face of said central annular body (20).

3. A rotary piston machine according to claim 1 wherein said inner rings (32) are rotatably supported by an eccentric trunnion (48).

4. A rotary piston machine according to claim 3 wherein said eccentric trunnion (48) is rigidly attached to or integral with a cover plate (40).

5. A rotary piston machine according to claim 1 wherein said central annular body (20) is rigidly attached to or integral with a plane driving disk (22) which in turn is connected to said drive shaft (18).

6. A rotary piston machine (10) according to claim 1 wherein said central annular body is guided between adjacent end faces (42, 52) positioned on opposite ends of said arc-shaped segments (24) and by a closing plate (60) eccentrically arranged relative to said second axis (a) of said stack (30).

7. A rotary piston machine according to claim 1 wherein said drive shaft (18) is integral with said central annular body (20).

8. A rotary piston machine according to claim 6 wherein said closing plate (60) is rigidly attached to a central trunnion (64).

9. A rotary piston machine according to claim 8 wherein said inner rings (32) of said ring stack (30) are rotatably borne by said central trunnion (64).

10. A rotary piston machine according to claim 1 wherein said ring stack (30) is encompassed by or supported within a jacket (62) of said casing (12, 40 60).

11. A rotary piston machine according to claim 1, wherein said casing (12, 40, 60) has a front face (52) that is sealingly and slidably engaged by said central annular body (20) and by a plane driving disk (22).

12. A rotary piston machine according to claim 1, wherein a cover plate (40) is bolted to said casing (12, 40, 60) and includes an end face (42) for sliding engagement of a facing ring component (f) of said ring stack (30).

13. A rotary piston machine according to claim 1, wherein an inner ring (32) of a ring-and-vane component (a) of said ring stack (30) is directly adjacent to a plane driving disk (22) that supports a slide disk (54) for close engagement therewith.

14. A rotary piston machine according to claim 1, which includes a bearing (16) for said drive shaft (18) that is covered by an outer disk (56) seated in said casing (12, 40, 60).

* * * * *